United States Patent [19]

Grunert et al.

[11] 4,307,361

[45] Dec. 22, 1981

[54] ELECTRIC CONTROL APPARATUS WITH AN ELECTROMECHANICAL LATCH DEVICE

[75] Inventors: Kurt A. Grunert, Beaver; Charles R. Paton, New Brighton, both of Pa.

[73] Assignee: Westinghouse Electric Corp., Pittsburgh, Pa.

[21] Appl. No.: 145,400

[22] Filed: May 1, 1980

[51] Int. Cl.[3] ..... H01H 50/32

[52] U.S. Cl. ..... 335/167; 335/132

[58] Field of Search ..... 335/167, 166, 165, 164, 335/168, 169, 170, 132

[56] References Cited

U.S. PATENT DOCUMENTS 3,325,690 6/1967 Kruzic et al. ..... 335/132

3,882,435 5/1975 Grass et al. ..... 335/167

*Primary Examiner*—Harold Broome

*Attorney, Agent, or Firm*—Benjamin Hudson, Jr.

[57] ABSTRACT

An electric control apparatus with an electromechanical latch device which allows the electric control device to be momentarily energized to one operating position, mechanically latched in that position, and released to return to its initial position after momentarily energizing the latch device mechanism.

5 Claims, 6 Drawing Figures

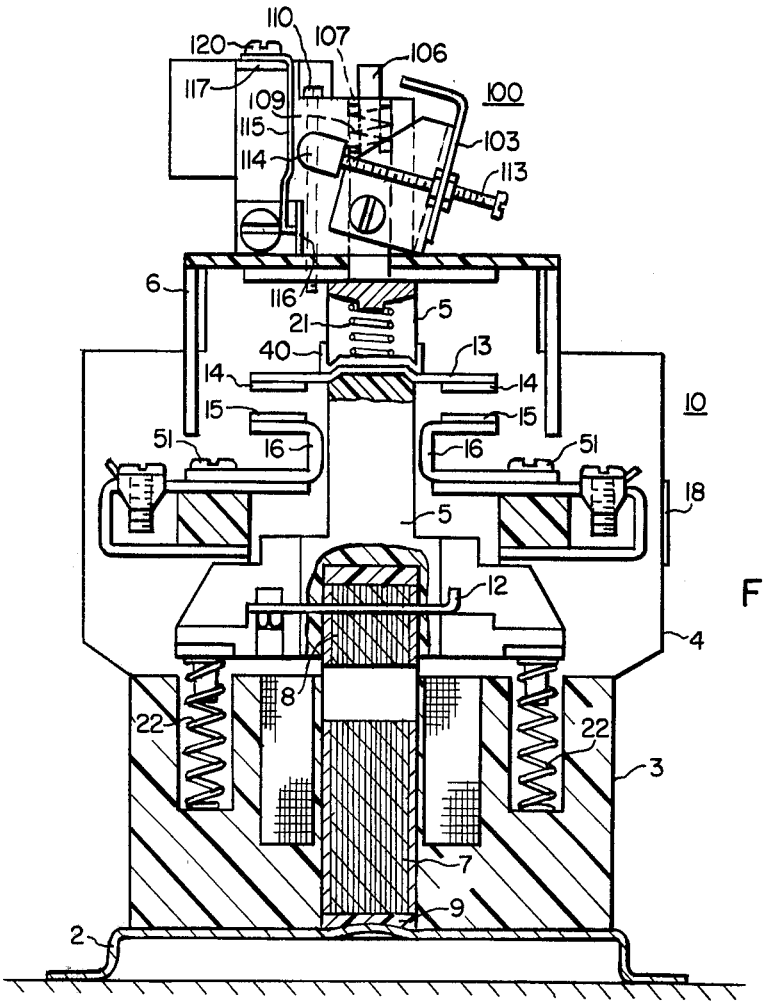
FIG. 4.
FIG. 2.
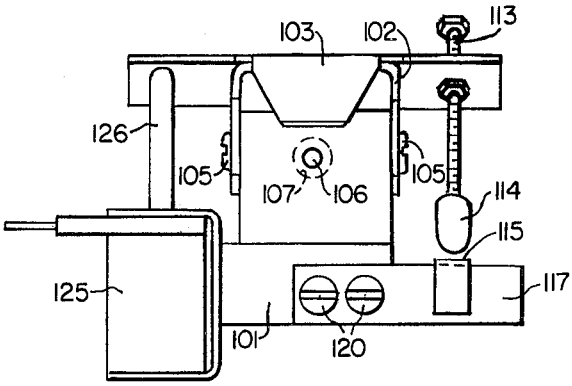
FIG. 3.
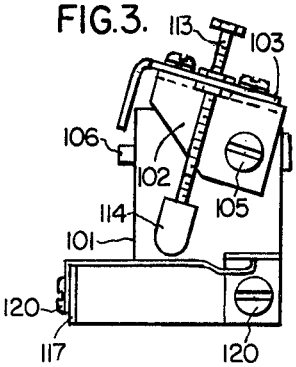

ELECTRIC CONTROL APPARATUS WITH AN ELECTROMECHANICAL LATCH DEVICE

BACKGROUND OF THE INVENTION

1. Field of the Invention

This invention relates generally to electric control apparatus, and more particularly to electric control devices such as contactors or relays with latching devices that releasably hold the electric control device in one operating position after momentary energization.

2. Description of the Prior Art

It is desirable in the art of electric control to be able to momentarily energize an electric control device such as a relay or contactor to one energized position and mechanically latch the device in that position. It is often desirable to add this latching feature to contactors or relays that were not designed with this feature in mind. However, mechanical latches that are added onto existing contactors or relay designs can be bulky, have complicated linkages, and are sometimes inoperable.

SUMMARY OF THE INVENTION

This invention provides an electric control device with an add-on mechanical latch design that is simple in its method of operation, takes up very little panel space, and also is adjustable to different contactor designs and variations. This invention also provides a means to combine the latching function with a coil-clearing contact which ensures that the coil of the electric control device is deenergized once the latching function is complete. This feature allows conventional relays, which would normally be continuously energized, to be mechanically latched in their operating positions and deenergized to save energy and coil life. It is yet another object of this invention to provide an electric control device with a latching mechanism that holds the device in an operating position after only momentary energization of the device and which the control device is automatically returned to its initial position by a latch device coil which releases the latch mechanism after the latch device coil has been energized momentarily. Thus, control relays and contactors without latching features can now be modified in the field with this innovation.

BRIEF DESCRIPTION OF THE DRAWING

FIG. 2 is a front elevational view of the latch device structure;

FIG. 3 is a side elevational view of the latch device structure;

FIGS. 4 and 5 are side elevational views with parts broken away of an electric control device and latch device in accordance with the principles of this invention.

DESCRIPTION OF THE PREFERRED EMBODIMENT

Figure 1:
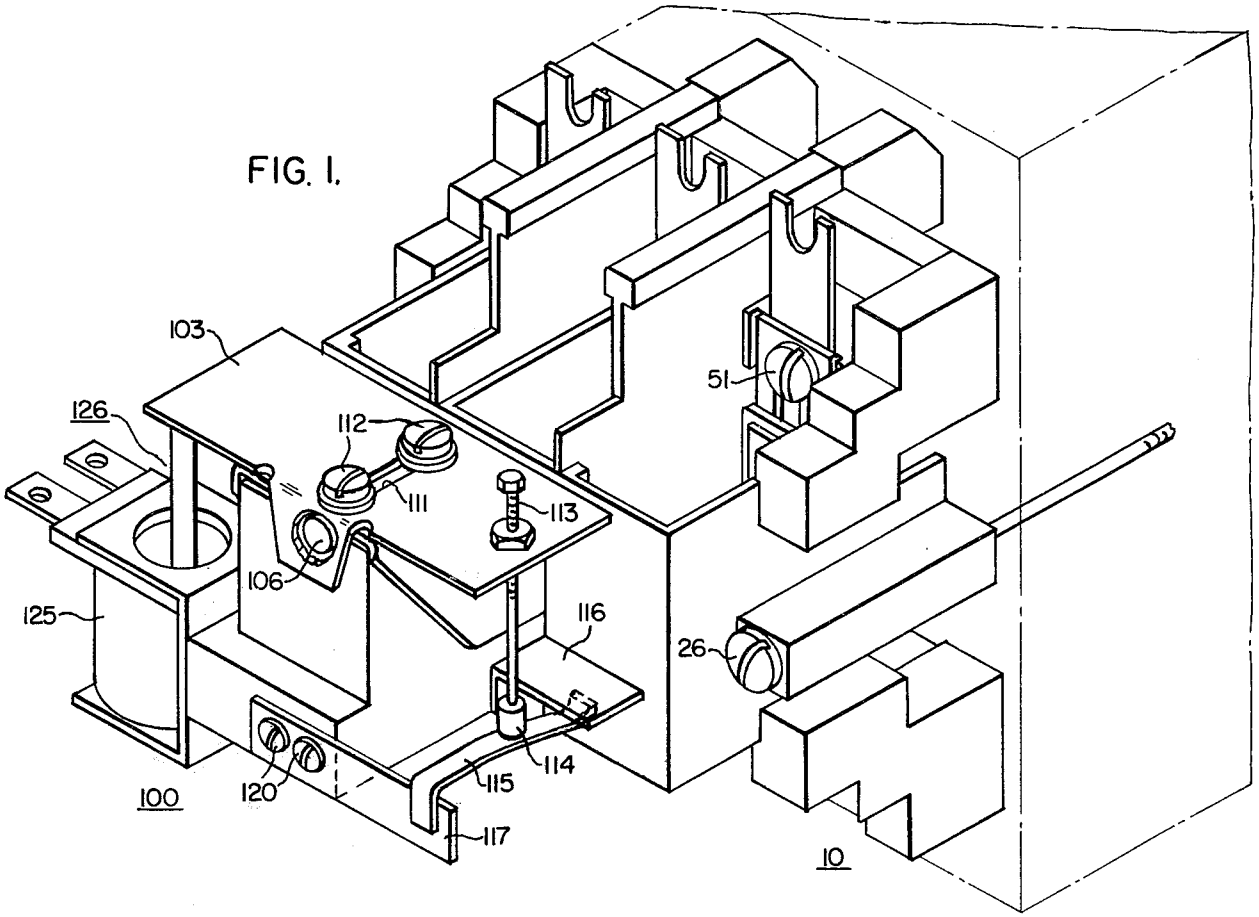
FIG. 1 is a perspective view of the electromechanical latch device mounted on an electric control device.
Figure 5:
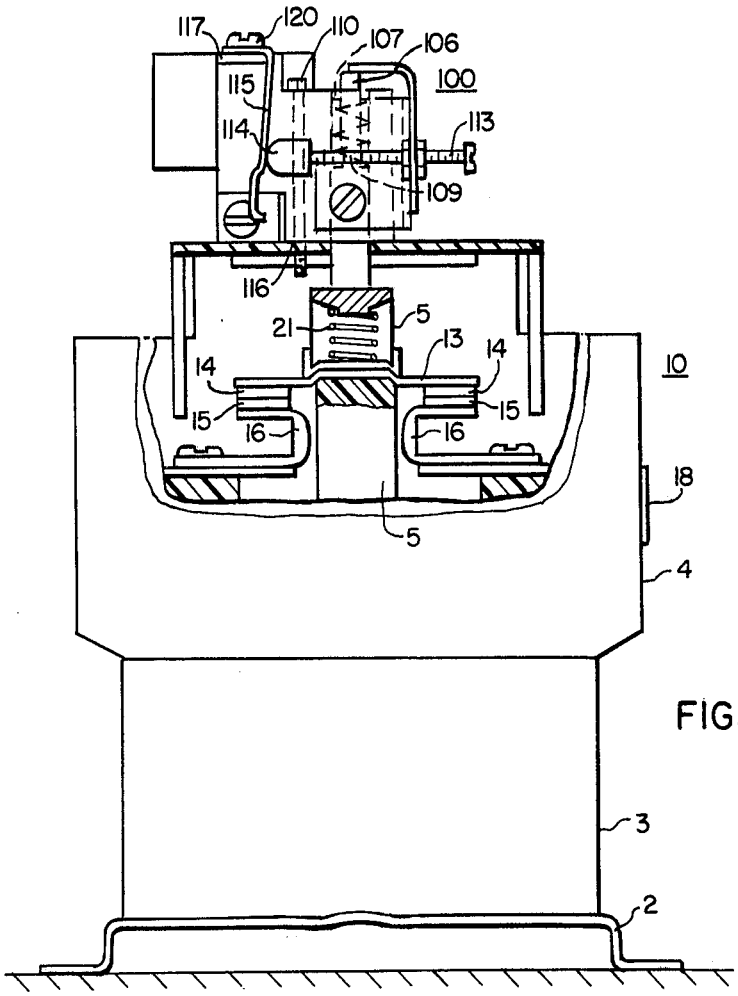

Referring to the drawings, there is shown in FIG. 4 an electric control device and latch device in accordance with the principles of this invention. The electric control device is of the type that is more specifically described in U.S. Pat. No. 3,296,567 issued to John P. Conner and Kurt A. Grunert on Jan. 3, 1967. The electric control device 10 comprises a metallic base plate 2 and a contactor structure comprising a lower base 3 and an upper base 4 of molded insulating material. The upper base 4 is secured to lower base 3 which is secured to the base plate 2 by two screws 26 shown in FIG. 1, which pass through apertures in the upper base 4, and apertures in the lower base 3 aligned with the apertures in the upper base 4, and secured in threaded apertures in the base plate 2, which are also in alignment with the apertures in the upper base 4 and the lower base 3. As can be seen in FIG. 4, the mounting plate 2 comprises a sheet metal plate member bent over at the four sides thereof to form four leg portions to support the generally rectangular upper supporting plate part of plate 2. The upper plate part comprises a generally planar supporting surface having a depression whereupon a supporting pad 9 is mounted that serves to support the core member 7, which is generally a U-shaped magnetic core comprising a plurality of laminations forming two leg parts that extend upward to provide two pole faces. The upper part of the contactor structure 10 comprises an upper housing part 4 of molded insulated material, a molded insulating contact carrier 5, a generally U-shaped magnetic armature 8, and an insulating arc hood device 6. A pair of conducting straps 18 are secured to the insulating housing upper base 4 by means of two screws 51. A separate terminal plate 16 is connected to the outer end of the conducting straps 18 by means of the terminal screw 51. A stationary contact 15 is brazed or otherwise solderably secured to the inner end of each of the terminal plates 16. A separate bridging contact member 13 is provided to bridge each pair of separated stationary contacts 15. Each of the bridging contact members 13 has two stationary contacts 14 secured to the opposite ends of the conductor 13. The insulating contact carrier 5 has window openings therein so that each of the bridging contact members 13 is supported on the contact carrier 5 in a separate window opening for each pole. The contact arrangement shown in FIG. 4 is typical for each pole of the electric control device. In each of the openings a separate compression spring 21 biases spring support 40 against the associated bridging contact member 13 to retain the member 13 in place and to provide for resilient contact engagement. The insulating contact carrier 5 has an opening therein and a generally U-shaped laminated magnetic armature 8 is supported in the opening on the the contact carrier 5 by means of a supporting pin 12 that passes through a suitable opening in the bight portion of the U-shaped armature 8 and is supported on ledges on a surface of the insulating contact carrier 5. During assembly of the upper base part 4, the contact structure 10, the insulating contact carrier 5 and the magnetic armature 8 are moved up through an opening from the bottom of the insulating housing part 4, and thereafter, the bridging contacts 13 are mounted in a position in the window openings of the contact carrier 5 to thereby secure the insulating contact carrier 5 and the armature 8 along with the bridging contact members 13 in a position on the upper housing part 4. Two springs 22 are mounted in the molded housing of the coil structure and engage the contact carrier 5 to bias the contact carrier, the armature 8 and the bridging contact members 13 to the upper unattracted position seen in FIG. 4. The contactor 10 is shown with the contact carrier 5 and armature 8 biased to the upper unattracted position by means of the spring 22. When the contact carrier 5 is in this position, the bridging contact members 13 are in the upper position separated from the stationary contacts 15 so that the poles of the contactor are normally open.

Figure 6:
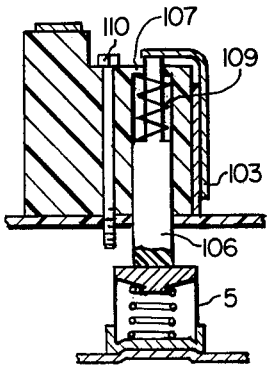
FIG. 6 is a side cross sectional view of the latch device in accordance with the principles of this invention.

Referring to FIGS. 1–6, there is shown a latch device structure 100 mounted upon the electric control device 10 by means of two screws 110 shown in FIG. 6. As can be seen in FIGS. 2 and 3, the latch device structure 100 comprises a base 101 made of an insulating material such as wood or hard plastic. A generally U-shaped member 102 is pivotally mounted upon the base 101 by means of two screws 105. Connected to the U-shaped member 102 is an adjustable generally rectangular shaped latching member 103 with a perpendicular projection as shown in FIGS. 1 and 3. The insulating base 101 has a hole 108 therein with a shoulder 107 as shown in FIGS. 3 and 4. A plunger 106 with a coil spring 109 connected to the plunger is inserted in the hole 108 whereby the coil spring 109 rests on the shoulder 107 and the plunger 106 passes through the hole 108 as shown. As shown in FIG. 4 the plunger 106 passes through a hole in the cover 6 of the contactor and rests upon the insulating contact carrier 5. The coil spring 109 is disposed to bias the plunger 106 in the direction of the contact carrier 5. As can be seen in FIG. 1 and as is also further illustrated in FIGS. 5 and 6 when the contactor is in its energized state, the insulating contact carrier 5 has moved the movable contacts to their closed position whereby the coil spring 109 biases the plunger 106 in the direction of the contact carrier 5. The perpendicular projection of the latching member 103 then falls over the plunger 106 by means of gravity or other biasing means shown in FIGS. 1, 5 and 6 thus latching the contactor in the energized position against its one biasing spring 22. The elongated slot 111 and the two screws 112 shown in FIG. 1 allow the latching mechanism to be adjusted to different contact designs. There is shown in FIG. 3 for example, connected to the latching member 103 a screw and nut combination 113 with a plastic insulating tip 114. The screw and nut combination 113 with its insulating tip 114 is disposed to open the movable cantilever type contact 115 to break electrical contact between the terminals 116 and 117 as the latching member 103 moves to the latched position. The screw and nut combination is also disposed to be adjustable for different contactor designs and configurations. The movable contact combination 115 is further disposed to be electrically wired in series with the coil 1 by means of the terminal screws 120 whereby the coil 1 is deenergized when the contactor is in the latched position.

There is also shown in FIGS. 1 and 2 a second coil 125 and armature 126 combination. The second armature 126 is disposed to move the latching member 103 to the unlatched position as shown in FIG. 3 when the coil 125 is momentarily energized. Once the latching member 103 releases the plunger 106 the biasing springs 22 of the contactor return the device to normally open position as shown in FIG. 4.

We claim:

1. An electric control apparatus, comprising: a control device and a latch device, said control device comprising a base; an insulated housing supported on the base; a control mechanism supported on the housing; the control mechanism comprising a first stationary and movable contact combination; the first stationary and movable contact combination being disposed to open and close an electric circuit; operating means disposed to operate the first contact combination between an open and closed position; a first biasing means disposed to bias the contact combination in a first operating position; said operating means comprising a first coil and armature combination whereby upon energization of the first coil, the first armature is disposed to move an insulating contact carrying structure; the contact carrying structure being disposed to move the contacts of the first contact combination to a second operating position against the first biasing means; said latch device comprising a latching means movable structure; the latching means movable structure comprising a second coil and armature combination; a latching member for latching the first armature and contact carrying structure in the second operating position; a second biasing means for biasing the latching member in the latched position; the second armature being disposed to move the latching member against the second biasing means to the unlatched position; a second stationary and movable contact combination being movable from an opened to a closed position; the second stationary and movable contact combination being electrically in series with the first coil and armature combination; and said latching member being disposed to move the second contact combination between the opened and closed position.

2. An electric control apparatus as recited in claim 1, whereby upon momentary energization of the first coil and armature combination; the first armature moves the insulating contact carrying structure from the first to the second operating position against the first biasing means, the second biasing means biasing the latching member to latch the insulating contact carrying structure in the second operating position; the latching member being disposed to move the second stationary and movable contact combination from the closed to the open position, whereby the first coil is deenergized; thereafter, upon momentary energization of the second coil and armature combination; the second armature being disposed to move the latching member against the second biasing means to the unlatched position; the second stationary and movable contact combination moves from the opened to closed position; the first biasing means biases the contact carrying structure to the first operating position, and maintain means operating automatically when the contact carrying structure is in the first operating position to maintain the latching means in the unlatched position against the bias of the second biasing means.

3. An electric control apparatus as recited in claim 1 further comprising adjustable means for adjusting the latching position of the latch member.

4. An electric control apparatus as recited in claim 1 further comprising adjustable means for adjusting the opening and closing positions of the second stationary and movable contact combination.

5. An electric control apparatus as recited in claim 1 further comprising mounting means for mounting the latching device on the electric control device whereby the latching device engages the insulating contact carrying structure of the electric control device.

* * * * *